US010201197B2

(12) United States Patent
Imbert

(10) Patent No.: US 10,201,197 B2
(45) Date of Patent: Feb. 12, 2019

(54) KNEE PROTECTION DEVICE

(71) Applicant: GIRD, Maroeuil (FR)

(72) Inventor: Luc Imbert, Bastia (FR)

(73) Assignee: GIRD, Maroeuil (FR)

( * ) Notice: Subject to any disclaimer, the term of this patent is extended or adjusted under 35 U.S.C. 154(b) by 385 days.

(21) Appl. No.: 14/902,530

(22) PCT Filed: Jun. 5, 2014

(86) PCT No.: PCT/FR2014/051343

§ 371 (c)(1),
(2) Date: Dec. 31, 2015

(87) PCT Pub. No.: WO2015/004346

PCT Pub. Date: Jan. 15, 2015

(65) Prior Publication Data

US 2016/0374413 A1 Dec. 29, 2016

(30) Foreign Application Priority Data

Jul. 11, 2013 (FR) ..... 13 56843

(51) Int. Cl.
*A41D 13/00* (2006.01)
*A41D 13/06* (2006.01)
*A41D 13/05* (2006.01)

(52) U.S. Cl.
CPC ..... *A41D 13/065* (2013.01); *A41D 13/0007* (2013.01); *A41D 13/0587* (2013.01); *A41D 2600/20* (2013.01)

(58) Field of Classification Search
CPC ..... A41D 17/00; A41D 17/005; A41D 17/02; A61F 5/05875; A61F 5/10; B01J 20/345
(Continued)

(56) References Cited

U.S. PATENT DOCUMENTS 1,510,408 A * 9/1924 Lychou ..... A61F 5/0106 602/16
4,433,679 A 2/1984 Mauldin et al.
(Continued)

FOREIGN PATENT DOCUMENTS

| | | |
|---|---|---|
| EP | 2 486 814 A1 | 8/2012 |
| NL | 1035336 C2 | 10/2009 |
| WO | 2010/088689 A1 | 8/2010 |

OTHER PUBLICATIONS

International Search Report, dated Aug. 13, 2014, from corresponding PCT Application.

*Primary Examiner* — Timothy K Trieu
(74) *Attorney, Agent, or Firm* — Young & Thompson

(57) ABSTRACT

Disclosed is knee protection equipment including: a unit for resting on the ground, intended to be positioned in the immediate vicinity of the knee, and/or the unit resting on the ground being intended to be positioned level with the tibia; a harness intended to be arranged level with the pelvis; the harness and the unit for resting on the ground being connected by a rigid arm intended to be positioned laterally and externally to the thigh, the equipment being able to pass from a standing position in which the unit for resting on the ground are positioned level with the knee and/or level with the tibia, to a kneeling position in which the unit for resting on the ground bear on the ground and are able to transmit at least part of the vertical load force to the harness.

9 Claims, 4 Drawing Sheets

(58) Field of Classification Search
USPC ..... 2/22, 23, 34; 602/5; 24/3.13; 128/80
See application file for complete search history.

(56) References Cited

U.S. PATENT DOCUMENTS

| | | | | | |
|---|---|---|---|---|---|
| 4,776,326 | A * | 10/1988 | Young | A61F 5/0102 | 602/16 |
| 6,769,134 | B1 | 8/2004 | Mendez | | |
| 6,872,187 | B1 * | 3/2005 | Stark | A61F 5/0102 | 482/8 |
| 6,913,583 | B2 * | 7/2005 | Jestrabek-Hart | A61F 5/0127 | 2/24 |
| 2010/0095422 | A1 | 4/2010 | Lopez et al. | | |

* cited by examiner

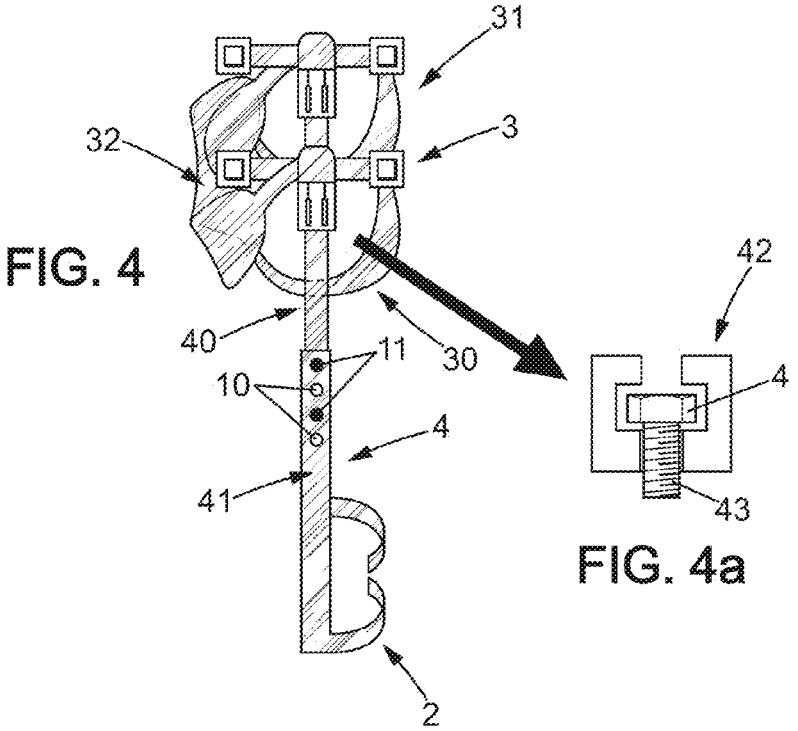
FIG. 4
FIG. 4a
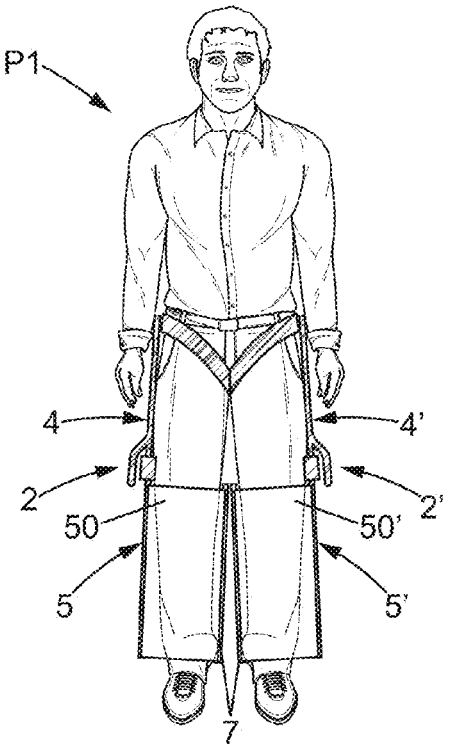
FIG. 5
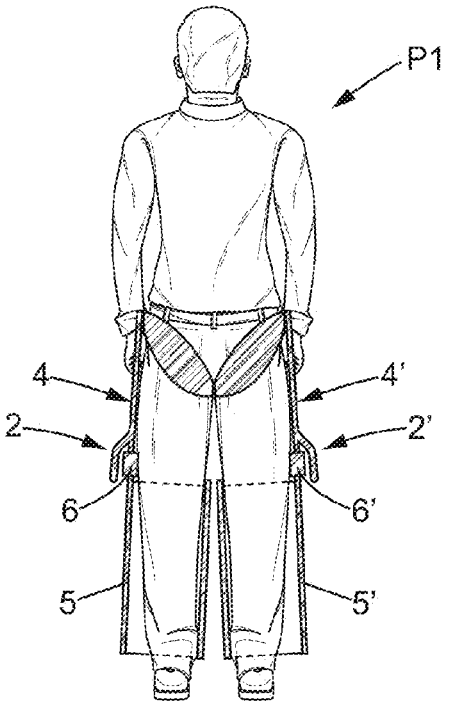
FIG. 6

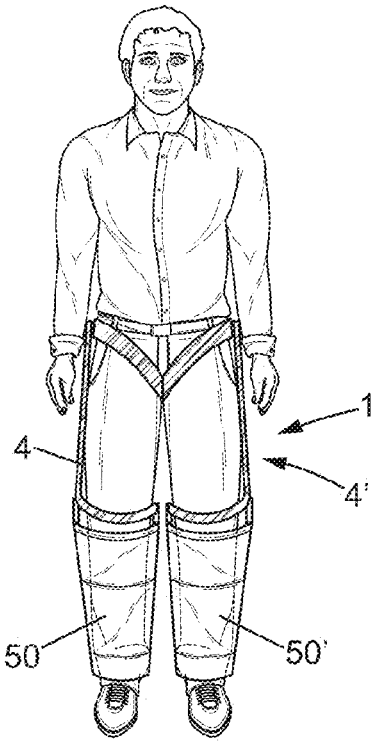
FIG. 10
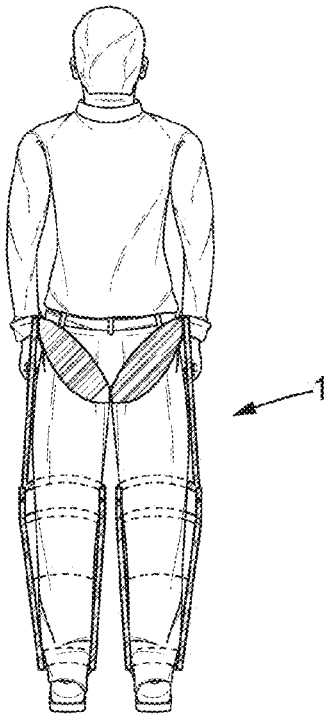
FIG. 11
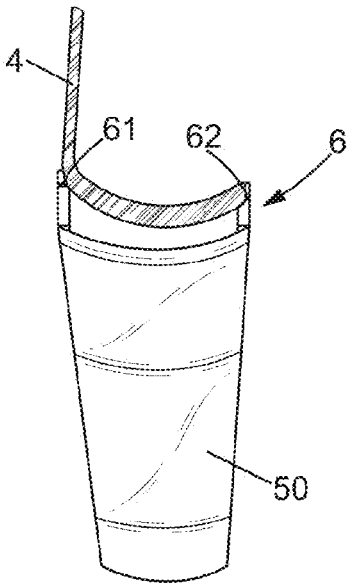
FIG. 10a
FIG. 12
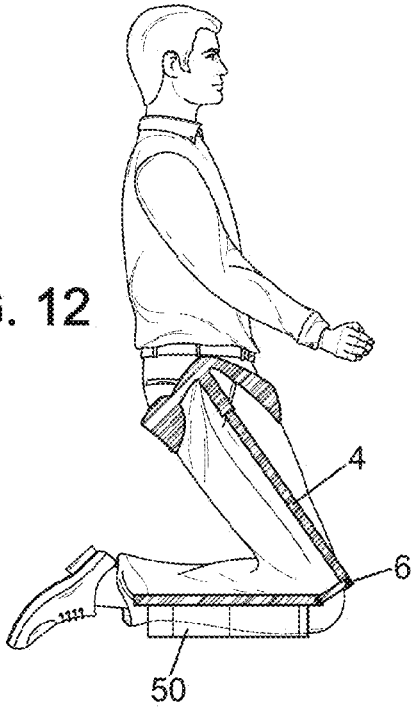

KNEE PROTECTION DEVICE

The invention relates to equipment for protecting knees intended for persons working on their knees, such as for example tilers.

Jobs requiring remaining in the kneeling position for a relatively long time cause various pathologies of the knee.

Using protection means for protecting the knees in the kneeling position, such as a kneepad for example, is known.

Generally, a protective kneepad comprising a cushion intended to be placed against a knee is used in order to bring relief to workpeople. Usually, the kneepad is held in place by elastic straps and/or bands that grip the bottom of the thigh and the top of the calf of the leg.

However, such a type of kneepad has several drawbacks, such as great discomfort in the long term and poor blood circulation.

In addition, often, the kneepad does not hold correctly in place and may be caused to slide and/or move laterally when the workman moves.

The aim of the present invention is to overcome the aforementioned drawbacks by proposing knee protection equipment that better relieves the knees of persons working in the kneeling position.

Another aim of the present invention is to propose equipment that is simple to use and fit.

Another aim of the present invention is to propose equipment that can be adapted to the body shape of the user.

These objectives, as well as others, which will emerge more clearly hereinafter, are achieved according to the invention by means of knee protection equipment, comprising:

means for resting on the ground, said means for resting on the ground being intended to be positioned in the immediate vicinity of the knee, and/or said means for resting on the ground being intended to be positioned level with the tibia, a harness intended to be arranged level with the pelvis;

said harness and said means for resting on the ground being connected by means of a rigid arm intended to be positioned laterally and externally to the thigh the equipment being able to pass from a standing position in which the means for resting on the ground are positioned level with the knee and/or level with the tibia, to a kneeling position in which the means for resting on the ground bear on the ground and are able to transmit at least part of the vertical load force to the harness.

According to features of the invention taken alone or in combination:

the equipment comprises means for resting on the ground for each of the two knees and/or the two tibias, respectively connected to the harness by means of two rigid arms;

said means for resting on the ground intended to be positioned level with the knee comprise a framework fixed rigidly to the distal end of said rigid arm;

said framework is semi-cylindrical in shape so as to pass round the knee from the front;

the means for resting on the ground comprise an element covering the tibia, connected to said rigid arm by articulation means;

the articulation means have a stop limiting the bending travel so that, in the position in which the articulation is locked, in the kneeling position, the means for resting on the ground bear on the ground and are able to transmit the load force to the harness;

said rigid arm is connected to said harness at its proximal end by means of a flexible connection or an articulated connection;

said rigid arm comprises means for adjusting its length so as to adapt the equipment to the body shape of the user.

The invention also concerns an assembly comprising equipment according to the invention and trousers, in which the equipment harness is secured to the trousers level with the pelvis.

Other features and advantages of the invention will emerge more clearly from a reading of the following description of a particular embodiment of the invention, given by way of simple illustrative and non-limitative example, and the accompanying drawings, among which:

FIG. 4 is a partial side view of the knee equipment of FIG. 1;

FIG. 4*a* is a detail view of the C-shaped rail in which the proximal end of the rigid arm of FIG. 4 may be fitted and locked.

Figure 7:
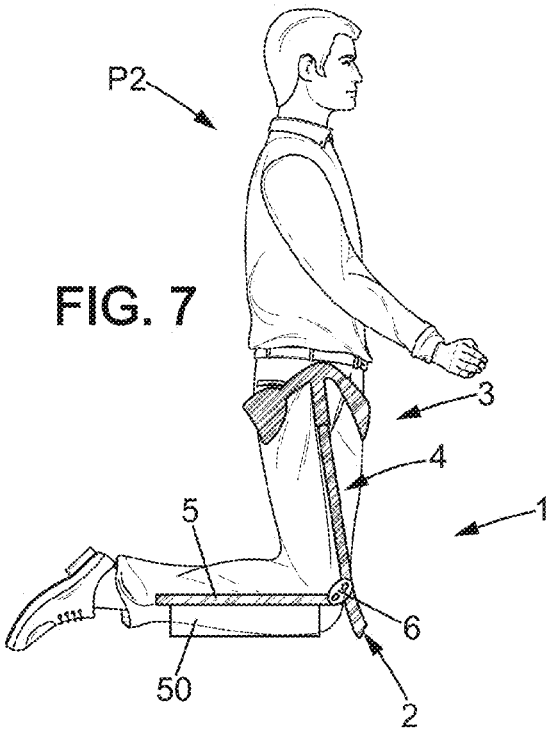
Figure 8:
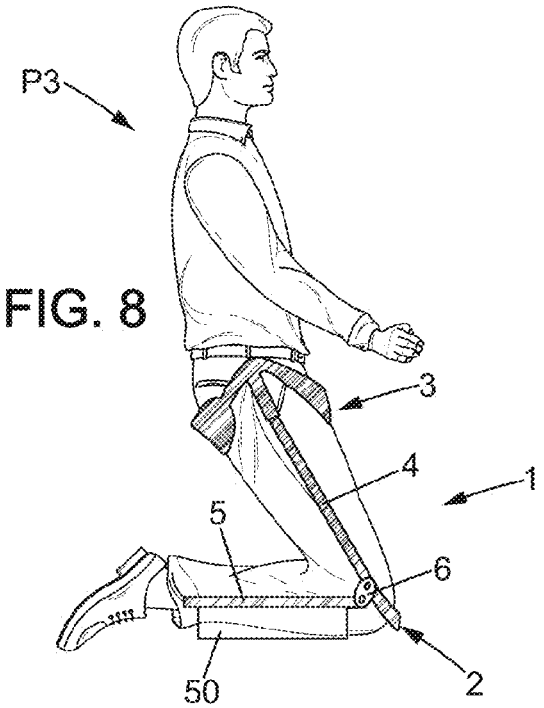
Figure 9:
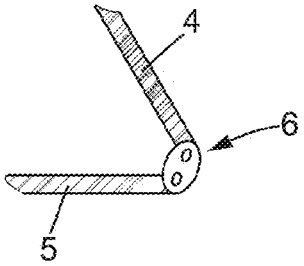

FIG. 5 is a schematic front view of the knee protection equipment according to a second embodiment of the invention, worn by the user, in the standing position of the user;

FIG. 6 is a rear view of FIG. 5;

FIG. 7 is a schematic profile view of the knee equipment in the kneeling position, the equipment at least partly absorbing the vertical load of the user, without transmitting it to the knees;

FIG. 8 is a schematic profile view according to FIG. 7, in the position of locking of the articulations between the arms;

FIG. 9 is a detail view of the articulation in FIG. 8, in the locking position;

FIG. 10 is a schematic front view of the protective equipment according to a third embodiment, worn by the user in the standing position of the user, FIG. 10*a* is a detail view of FIG. 10, FIG. 11 is a rear view of the equipment according to FIG. 10, and FIG. 12 is a schematic profile view of the equipment in the kneeling position.

As previously mentioned, the general principle of the invention is therefore based on the use of knee protection equipment intended in particular for equipping workmen spending the majority of their time kneeling, such as tilers.

Figure 1:
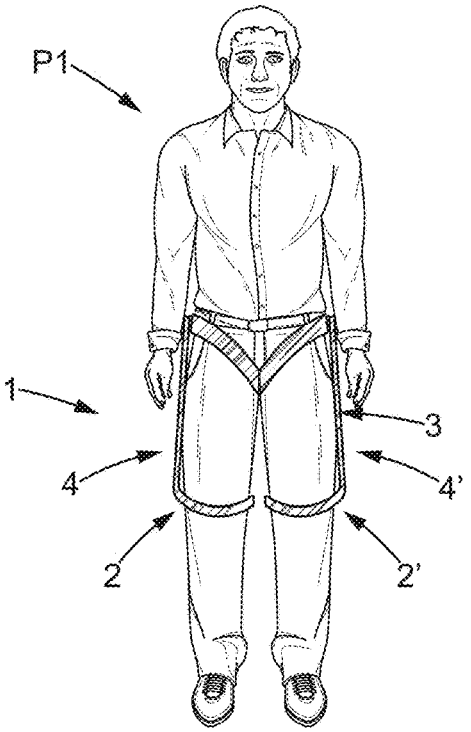
FIG. 1 is a schematic front view of the knee protection equipment according to one embodiment of the invention, worn by the user, in the standing position of the user.

As can be observed in FIG. 1 or FIG. 5 or 10, the knee protection equipment 1 comprises:

means 2, 2'; 50, 50' for resting on the ground, the means 2, 2' for resting on the ground being intended to be positioned in the immediate vicinity of the knee and/or the resting means 50, 50' being intended to be positioned level with the tibia, a harness 3 intended to be disposed level with the pelvis of the user.

According to an embodiment illustrated non-limitatively in FIGS. 1 to 4, the resting means 2, 2' are situated at the knee; said harness 3 and said means 2, 2' for resting on the ground are connected together by means of a rigid arm 4, 4' intended to be positioned laterally and externally to the thigh.

The equipment 1 makes it possible to change from a standing position P1 in which the user stands upright and in which the means for resting on the ground 2, 2' are positioned, at the knee (in front of the knee and/or laterally to the knee), to a kneeling position P2 in which the user is kneeling and in which the resting means 2, 2' rest on the ground and are able to transmit at least part of the vertical load force of the harness 3, so as to relieve the knee of the user.

Alternatively, the resting means 50, 50' are situated level with the tibia, the harness 3 and said means for resting on the ground 50, 50' being connected together by means of a rigid arm 4, 4' intended to be disposed laterally and externally to the thigh, referred to as the first rigid arm, the resting means 50, 50' being articulated on said rigid arm 4, 4'.

According to the example in FIGS. 2 to 6, the resting means 50, 50' comprise a second rigid arm 5, 5' intended to be positioned externally and laterally to the calf and articulation. The second rigid arm 5, 5' is articulated on said first rigid arm 4 by means of an articulation 6, disposed externally and laterally at the knee.

According to this alternative, the equipment 1 may pass from a standing position P1 in which the means for resting on the ground 50, 50' are level with the tibia, to a kneeling position P3, referred to as seating, in which the articulation or articulations 6 are in abutment and the means for resting on the ground 50, 50' bear on the ground and are able to transmit the load force to the harness 3.

According to yet another alternative illustrated in FIGS. 5 to 8, the means for resting on the ground may be situated at the knee, rigidly secured to the first rigid arm 4, 4' and level with the tibia, comprising the second rigid arm 5, 5'. The equipment 1 can pass from a standing position P1 (i.e. FIG. 5 or 6) in which the means for resting on the ground 2, 2', 50, 50' are positioned at the knee and level with the tibia, to a first kneeling position P2 (i.e. FIG. 7) in which the means for resting on the ground 2, 2' positioned at the knee bear on the ground and are able to transmit at least some of the vertical load force to the harness 3 and, in addition, to a second kneeling position P3 (i.e. FIG. 8), referred to as seated, in which the articulation or articulations 6 are in abutment and the means for resting on the ground 50, 50' at the level of the tibia bear on the ground and are able to transmit the load force to the harness 3.

Figure 2:
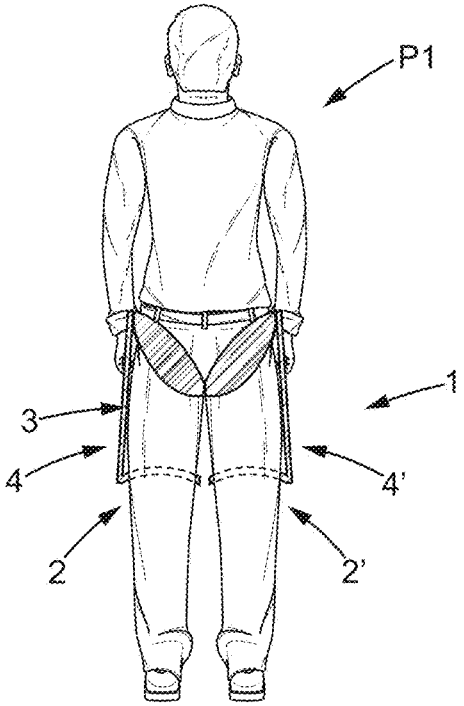
FIG. 2 is a rear view of FIG. 1.

In the standing position as illustrated in FIGS. 1 and 2 or in FIGS. 5 and 6 or in FIG. 10, the user has the possibility of moving. To this end the arm or arms 4, 4' are able to move with respect to the harness 3 in order to follow the thighs of the user when walking. To this end, said rigid arm 4, 4' can be connected to the harness at its proximal end by means of a flexible connection or an articulated connection. For example, the flexible connection comprises straps connected to the harness 3 and a means of fixing the rigid arm 4. Such a flexible connection affords a greater degree of freedom when the user has to move with the protection equipment.

Figure 3:
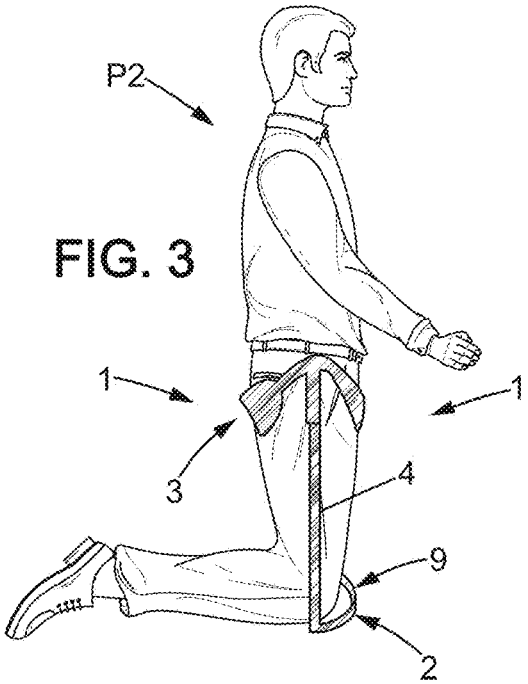
FIG. 3 is a schematic profile view of the knee equipment in the kneeling position of the user, the equipment at least partly absorbing the vertical load of the user, without transmitting it to the knees.

In the kneeling position as illustrated in FIG. 3 or in FIG. 7, the resting means 2 or 2' associated with a knee bear on the ground and make it possible to transmit all or part of the load of the harness to the ground, without transmitting it to the knee. The weight of the user is thus absorbed by the harness and transmitted to the ground, without transmitting the force to the knee.

Preferably, the knee protection equipment 1 protects the two knees of the user and for this purpose comprises two means 2, 2'; 50, 50' for resting on the ground, each of the two means 2, 2'; 50, 50' for resting on the ground being positioned at one of the two knees and/or the two tibias, so that each knee of the user is provided with relief.

The two means 2, 2'; 50, 50' for resting on the ground are respectively connected to the harness 3 by means of two rigid arms 4, 4'.

The means 2, 2' for resting on the ground at the knee or knees may each comprise at least one framework rigidly fixed to the distal end of the rigid arm 4. Said rigid arm 4 may be connected to the harness 3 at its proximal end by means of a removable fixing.

According to one embodiment, illustrated non-limitatively in FIG. 2, the framework 9 is semi-cylindrical in shape so that the framework 9 conforms to the morphology of the knee and passes round it from the front. Such a form makes it possible not to interfere with the user when the latter passes from the standing position to the kneeling position. The framework 9 may be fixed removably or not to the rigid arm 4.

As can be observed in FIG. 3, in the kneeling position, the framework 9 bears on the ground, the knees of the user rest lightly on the ground or even do not rest at all on the ground, the vertical load of the user being transmitted to the harness 3 by means of the rigid arms 4, in whole or in part.

According to a particular embodiment of the invention illustrated in FIGS. 5 to 9, said rigid arm 4, 4' is referred to as the first rigid arm. Said first rigid arm is extended by said second rigid arm 5, 5', said second rigid arm 5, 5' being articulated on said first rigid arm 4, 4' by means of an articulation 6, disposed externally and laterally at the knee.

The means for resting on the ground 50, 50' may comprise said second rigid arm 5, 5'. Said articulation 6 comprises stops optionally defining a maximum bending position, illustrated non-limitatively in FIGS. 5 and 6, and a kneeling position, referred to as seated, in which said second means for resting on the ground 50, 50' level with the tibia or tibias bear on the ground and are able to transmit the vertical load force of said harness 3.

As can be observed in FIG. 4, the means for resting on the ground level with the tibia 50, 50' may comprise, for the or each tibia, an element in a single piece covering the tibia over its length. The element may take the form of a tibia protector and be rigidly secured laterally, externally to said corresponding second arm 5 or 5'. A third reinforcing rigid arm 7 may be secured rigidly to the element, laterally, on the inside.

In the standing position, the first rigid arms 4 extend along the thigh on the outside, the articulations 6 are situated level with the knees, and the second rigid arms 5, 5' and optionally the third rigid arms 7 extend respectively along the external and internal side of the tibia, the elements 50, 50' being situated level with the tibias.

In the kneeling position as illustrated in FIG. 7, for which the first branch 4 or 4' forms with the second branch 5, 5' an angle of approximately 90°, the resting means 2, 2' associated with the first rigid arms 4, 4', situated at the knees, bear on the ground. These resting means 2, 2' may comprise, for each knee, a framework disposed laterally to the articulation 6 and projecting below the latter, according to the non-limitative example in FIGS. 5 to 7.

In the kneeling position as illustrated in FIG. 8, the articulation 6 locks after bending by a certain angle between the first arm 4 and the second arm 5, substantially less than 90°, such as 45° for example, in particular between 50° and 30°, to enable the user to maintain himself in the seated position while resting on the harness 3. In this seated position, the weight of the user is absorbed by the harness 3 and transmitted to the ground by means of the first arms 4, 4', the articulations 6 in abutment, the second arms 5, 5' and the resting means 50, 50' positioned level with the tibia.

The articulation travel 6 between the seated position and the maximum bending position moreover enables the user to walk.

According to a third embodiment illustrated in FIGS. 10 to 12, the resting means 50, 50' are situated level with the tibias and comprise, for each leg, an element covering the tibia. Each of the resting means is articulated on said rigid arm 4 or 4' by means of articulations 61, 62 distributed on either side, at the knee.

Advantageously, the rigid arms 4, 4' may comprise means 40 for adjusting for length so as to adapt the size of the equipment 1 to the body shape of the user. To this end, each rigid arm 4, 4' may comprise two parts 40, 41 which can be positioned in different adjustment positions with respect to each other by means of a plurality of adjustment orifices 11 and a fixing member such as studs 10 cooperating with the orifices 11.

Obviously any other adjustment means known to persons skilled in the art may be adapted.

Advantageously, the means 2, 2' and/or 50, 50' for resting on the ground may be removable and the rigid arms 4, 4' and/or 5, 5' may be separated from the harness 3 by a removable fixing means. The proximal end of the rigid arm 4 may be fitted in a C-shaped rail 42 and locked in the latter by means of a locking screw 43, as illustrated in FIG. 4*a*. The proximal end of the rigid arms 4, 4' may also, for example, be clipped to the harness 3.

The invention also relates to an assembly comprising equipment 1 according to the invention and trousers 8, in which the harness 3 is secured to the trousers 8, for example by stitching, level with the pelvis and buttocks, the rigid arms 4 being secured to the harness 3 close to the hips.

More precisely, the belt 32 of the harness 3 may be disposed level with the pelvis and the two thigh pieces 30, 31 of the harness 3 may be stitched to the trousers and disposed level with the bottom part of the buttocks. For example, the thigh pieces 30, 31 are each connected to the belt by means of a strap passing at the crotch, the length of these straps being adjustable, the connecting points between the belt strap and the thigh-piece straps forming the flexible connection and a lateral anchoring point for the rigid arms 4.

According to one embodiment of the invention, the knee protection equipment 1 may be integrated inside the trousers, in particular for aesthetic reasons, in particular at least the resting means 2, 2' and the arm or arms 4, 4'; 5, 5' of the equipment.

It can also be envisaged disposing the equipment outside the trousers 8. Preferably the resting means 2, 2'; 50, 50', the rigid arms 4, 4'; 5, 5' may be separate from the harness and trousers, in particular the cleaning of the trousers.

Naturally other embodiments could have been envisaged by persons skilled in the art without departing from the scope of the invention defined by the following claims.

LIST OF PARTS

1. Equipment
2, 2'. Means for resting on the ground (at the knee or knees)
3. Harness
4, 4'. Rigid arms (first arms)
5, 5'. Second rigid arm (second resting means)
6. Articulation means (between first arm and second arm)
7. Third arm
8. Trousers
9. Framework
10. Stud
11. Orifice
30, 31. Thigh piece (harness 3)
32. Belt (harness 3)
40. Adjustment means
42. C-shaped rail
43. Locking screw
50, 50'. Means for resting on the ground (at the tibia or tibias)

The invention claimed is:

1. A knee protection equipment for a person kneeling on a ground comprising:

a left means for resting on the ground configured to be positioned at a level corresponding to the left tibia of the person, comprising a left element (50) configured to cover the left tibia of the person;

a right means for resting on the ground configured to be positioned at a level corresponding with the right tibia of the person, comprising a right element (50') configured to cover the right tibia of the person;

a harness (3) configured to be positioned at a level corresponding with the pelvis of the person so that the person can sit in the harness, said harness (3) and said left element (50) is connected by a first left rigid arm (4) configured to be positioned laterally and externally to the left thigh of the person, wherein:

said first left rigid arm (4) is connected to said harness (3) at a first proximal end by a first connection, said first left element (50) is connected to said first left rigid arm (4) at a distal end by a first articulation (6) via a second left rigid arm (5) secured to the left element (50), said first articulation (6) joining and articulating said first left rigid arm (4) and said second left rigid arm (5), said harness (3) and said right element (50') is connected by a first right rigid arm (4') configured to be positioned laterally and externally to the right thigh of the person, wherein:

said first right rigid arm (4') is connected to said harness (3) at a second proximal end by a second connection, said first right element (50') is connected to said first right rigid arm (4') at a distal end by a first articulation (6') via a second right rigid arm (5') secured to the right element (50'), said first articulation (6') joining and articulating said first right rigid arm (4') and said second right rigid arm (5'), the knee protection equipment being able to pass from a standing position by the person in which the left means for resting on the ground and the right means for resting on the ground are positioned at a level corresponding with the tibia of the person, to a kneeling position by the person in which the left means for resting on the ground and the right means for resting on the ground bear on the ground and are able to transmit at least part of a vertical load force applied by the person to the harness, and wherein:

said first articulation (6) and said second articulation (6') each have a stop that limits a bending motion to a locked position, in the kneeling position by the person, said first left element (50) and said first right element (50') each bears on the ground and each is able to transmit the load force applied by the person to the harness, said first articulation (6) is configured to lock after bending by a first angle as measured between said first left rigid arm (4) and said second left rigid arm (5) of less than 90°, and said second articulation (6') is configured to lock after bending by a second angle as measured between said first right rigid arm (4') and said second right rigid arm (5') of less than 90° to enable the person to maintain a seated position while resting on the harness (3).

2. The equipment according to claim 1, wherein said left means for resting on the ground and said right means for resting on the ground are further configured to be positioned level with the left knee and the right knee of the person, respectively, and comprise a framework fixed rigidly to a distal end of said left rigid arm and said right rigid arm, respectively.

3. The equipment according to claim 2, wherein in which said framework is semi-cylindrical in shape so as to pass round the left knee and the right knee of the person from the front of the person.

4. The equipment according to claim 1, wherein each of said left rigid arm and said right rigid arm has a length, each comprises means for adjusting its the length so as to adapt the knee protection equipment to a body shape of the person, and each comprises two parts that are configured to be positioned with respect to each other by a plurality of adjustment orifices (11).

5. The knee protection equipment according to claim 1, wherein:

said first articulation (6) is configured to lock after bending by a said first angle as measured between said first left rigid arm (4) and said second left rigid arm (5) of between 30° and 50°, and said second articulation (6') is configured to lock after bending by said second angle as measured between said first right rigid arm (4') and said second right rigid arm (5') of between 30° and 50°.

6. The knee protection equipment according to claim 1, wherein:

said first connection by which said first left rigid arm (4) is connected to said harness (3) at said first proximal end is a flexible connection comprising a strap, and said second connection by which said first right rigid arm (4') is connected to said harness (3) at said second proximal end is a flexible connection comprising a strap.

7. The knee protection equipment according to claim 1, wherein:

said first connection by which said first left rigid arm (4) is connected to said harness (3) at said first proximal end is an articulated connection, and said second connection by which said first right rigid arm (4') is connected to said harness (3) at said second proximal end is an articulated connection.

8. An assembly comprising a knee protection equipment for a person kneeling on a ground comprising:

a left means for resting on the ground configured to be positioned at a level corresponding to the left tibia of the person, comprising a left element (50) configured to cover the left tibia of the person;

a right means for resting on the ground configured to be positioned at a level corresponding with the right tibia of the person, comprising a right element (50') configured to cover the right tibia of the person;

a harness (3) configured to be positioned at a level corresponding with the pelvis of the person so that the person can sit in the harness, said harness (3) and said left element (50) is connected by a first left rigid arm (4) configured to be positioned laterally and externally to the left thigh of the person, wherein:

said first left rigid arm (4) is connected to said harness (3) at a first proximal end by a first connection, said first left element (50) is connected to said first left rigid arm (4) at a distal end by a first articulation (6) via a second left rigid arm (5) secured to the left element (50), said first articulation (6) joining and articulating said first left rigid arm (4) and said second left rigid arm (5), said harness (3) and said right element (50') is connected by a first right rigid arm (4') configured to be positioned laterally and externally to the right thigh of the person, wherein:

said first right rigid arm (4') is connected to said harness (3) at a second proximal end by a second connection, said first right element (50') is connected to said first right rigid arm (4') at a distal end by a first articulation (6') via a second right rigid arm (5') secured to the right element (50'), said first articulation (6') joining and articulating said first right rigid arm (4') and said second right rigid arm (5'), the knee protection equipment being able to pass from a standing position by the person in which the left means for resting on the ground and the right means for resting on the ground are positioned at a level corresponding with the tibia of the person, to a kneeling position by the person in which the left means for resting on the ground and the right means for resting on the ground bear on the ground and are able to transmit at least part of a vertical load force applied by the person to the harness, and wherein:

said first articulation (6) and said second articulation (6') each have a stop that limits a bending motion to a locked position, in the kneeling position by the person, said first left element (50) and said first right element (50') each bears on the ground and each is able to transmit the load force applied by the person to the harness, said first articulation (6) is configured to lock after bending by a first angle as measured between said first left rigid arm (4) and said second left rigid arm (5) of less than 90°, and said second articulation (6') is configured to lock after bending by a second angle as measured between said first right rigid arm (4') and said second right rigid arm (5') of less than 90° to enable the person to maintain a seated position while resting on the harness (3), and trousers, wherein said harness of the equipment is secured to the trousers at a location configured to be level with the pelvis of the person.

9. The assembly according to claim 8, wherein said left means for resting on the ground, said right means for resting on the ground, said left rigid arm, and said right rigid arm are internal to the trousers.

* * * * *